US007731321B2

(12) United States Patent
Furuhata

(10) Patent No.: US 7,731,321 B2
(45) Date of Patent: Jun. 8, 2010

(54) IMAGE RECORDING APPARATUS AND POWER SHUTOFF PROCESS METHOD FOR USE THEREIN

(75) Inventor: Tsuyoshi Furuhata, Tokyo (JP)

(73) Assignee: Olympus Corporation, Tokyo (JP)

( * ) Notice: Subject to any disclaimer, the term of this patent is extended or adjusted under 35 U.S.C. 154(b) by 98 days.

(21) Appl. No.: 12/079,620

(22) Filed: Mar. 27, 2008

(65) Prior Publication Data

US 2008/0238970 A1 Oct. 2, 2008

(30) Foreign Application Priority Data

Mar. 28, 2007 (JP) ..... 2007-085357

(51) Int. Cl.
*B41J 29/38* (2006.01)

(52) U.S. Cl. ..... 347/14; 347/19; 347/22; 347/101

(58) Field of Classification Search ..... 347/14, 347/22–23, 29–30, 33, 35, 19, 60, 101, 104, 347/116
See application file for complete search history.

(56) References Cited

U.S. PATENT DOCUMENTS 6,612,681 B2 * 9/2003 Hasegawa et al. ..... 347/22

FOREIGN PATENT DOCUMENTS

JP 11-10872 A 1/1999
JP 3506356 B2 12/2003

* cited by examiner

*Primary Examiner*—Thinh H Nguyen
(74) *Attorney, Agent, or Firm*—Frishauf, Holtz, Goodman & Chick, P.C.

(57) ABSTRACT

A recovery mechanism comprises a recovery unit for performing a recovery process for recovering from clogging or contamination by ink in the nozzle array constituted by a plurality of nozzles. A conveyance mechanism supports and conveys, downstream, a recording medium that is conveyed from the upstream area of a conveyance path and handed over. A power control unit makes a control unit control the shutoff of a power supply to the nozzle array drive unit that drives the nozzle array when an abnormality occurs in the supporting and conveying of the recording medium that is performed by the conveyance mechanism in the recording process using the ink jetted from a plurality of nozzles or when the recovery unit makes contact with the nozzle array during recovery of the nozzle array in the recovery process.

9 Claims, 9 Drawing Sheets

IMAGE RECORDING APPARATUS AND POWER SHUTOFF PROCESS METHOD FOR USE THEREIN

CROSS REFERENCE TO RELATED APPLICATIONS

This application claims the benefit of Japanese Application No. 2007-085357 filed on Mar. 28, 2007, the contents of which are incorporated herein by this reference.

BACKGROUND OF THE INVENTION

1. Field of the Invention

The present invention relates to an image recording technique and in particular to a technique for recording an image by using a conductive ink.

2. Description of the Related Art

An inkjet full-line color printer is known as an image recording apparatus for recording an image on a recording medium such as paper. A full-line color printer is equipped with the nozzle array recording heads of respective colors separated from one another in predetermined intervals in the direction of conveying a recording medium, that is, the feed direction thereof. A plurality of nozzles for jetting ink are arrayed in each of the nozzle arrays so as to be formed across a length which is no less than the width of a recording medium in a direction orthogonal to the aforementioned feed direction, that is, the cross-feed direction.

Such an image recording apparatus, that is, a color printer, is equipped with its nozzle arrays facing the recording medium, so that a desired character and/or image are recorded by jetting ink onto the recording medium from the plurality of nozzles equipped in the individual nozzle arrays of respective colors.

A technique related to such a nozzle array (i.e., a recording head) is disclosed by the inkjet head noted in, for example, registered Japanese Patent No. 3506356. This reference patent document has disclosed a configuration in which ink chambers are equipped parallelly by forming a large number of channels on a base plate made from a piezoelectric transducer (PZT), with an electrode being formed on the internal surfaces of the respective ink chambers. In the inkjet head, the volume of the individual ink chamber is changed by applying a voltage to the electrode and thereby the ink is jetted.

The aforementioned reference patent document has also disclosed the manufacturing technique of the inkjet head. In this manufacturing technique, a first channel (i.e., an ink chamber) and a second channel are formed by processing a base plate, i.e., the PZT, and a discrete electrode and a common electrode are formed on the aforementioned base plate. The patent document further describes a configuration example of a conventional inkjet head. The inkjet head comprises an ink chamber formed by a side wall partly consisting of a piezoelectric transducer (PZT), an interval (or space) equipped between individual ink chambers, a discrete electrode, a common electrode, and a nozzle plate forming a nozzle (i.e., an inkjet nozzle) communicating with each respective ink chamber.

In the meantime, the demand for an aqueous ink in place of the conventional pigment ink as the ink used for an image recording apparatus has been increasing in recent years in consideration of environmental problems and such.

FIG. 1 is a cross-sectional diagram illustrating the structure of a conventional recording head premising the use of a conductive ink.

Referring to FIG. 1, in a recording head 43, a base plate 45 forms ink chambers 37, that is, a plurality of channels, with an interval 41 being equipped between individual ink chambers 37. A side wall made from a piezoelectric transducer (PZT) is formed on either side of the ink chamber 37, separating the ink chamber 37 from the interval 41. A nozzle plate 38 forming a nozzle 38*a* is equipped below the ink chamber 37. Note that the nozzle plate 38 is equipped so that the ink within the ink chamber 37 is conduced to the nozzle 38*a*.

Further, a discrete electrode 42 is equipped on the side wall 44 toward the ink chamber 37, with an insulation film 40 covering the discrete electrode 42. Further, a drive cable is connected to the discrete electrode 42 so that a drive signal generated by a drive circuit 39 is given to the discrete electrode 42.

Further, a common electrode 46 is equipped on the side wall 44 near the interval 41. A common cable is connected to the common electrode 46, which is conductive to, for example, the ground (GND) (i.e., zero volts) of the drive circuit 39.

Thusly configured individual ink chambers 37 of the recording head 43 store respective conductive inks 37*a* supplied from ink supply systems. In this event, the drive circuit 39 providing a potential difference (i.e., a drive signal) between the discrete electrode 42 and common electrode 46 causes the side wall 44 made from the piezoelectric transducer (PZT) to deform and accordingly the volume of the ink chamber 37 to change. Then the conductive inks 37*a* stored in the ink chambers 37 are jetted out of the nozzle 38*a*.

Next is a description of the operation of an image recording apparatus when it receives job information required for recording an image and starts an image recording.

In this event, having received the job information from a host apparatus, the image recording apparatus sometimes performs the process for moving a conveyance mechanism that supports and conveys a recording medium at the position opposite to the nozzle array to the recording process (i.e., the image recording) position by driving, for example, a conveyance mechanism elevation unit. The reason for this is that, when the image recording apparatus is left without, for example, any recording process being carried out, the image recording apparatus performs the process for retracting the conveyance mechanism below the nozzle array and making a droplet reception unit receive ink droplets dropping from the nozzle of the nozzle array.

Therefore, the image recording apparatus performs a recording process in the process of the conveyance mechanism supporting and conveying the recording medium conveyed from the upstream area of the conveyance path of the recording medium after completing the process for moving the conveyance mechanism to the recording process position.

Note that such a conveyance mechanism is generally earth-grounded to the frame of the image recording apparatus.

Meanwhile, it is generally known that an image recording apparatus carries out a recovery process in order to prevent an increase in the viscosity of the ink within the nozzle and a consequent clogging of the inkjet hole.

The recovery mechanism of the image recording apparatus comprises a reception unit for receiving an ejected ink droplet and a wiping unit for wiping ink that has dripped from a nozzle in order to prevent ink contamination within the apparatus.

Note that such a recovery mechanism is generally grounded to the frame of the image recording apparatus.

SUMMARY OF THE INVENTION

According to one of the aspects of the present invention, an image recording apparatus comprising at least one recording unit that includes a nozzle array constituted by a plurality of nozzles and includes a nozzle array drive unit for driving the aforementioned nozzle array, and comprising a conveyance mechanism for supporting and conveying a recording medium that is conveyed from the upstream area of a conveyance path and on which a recording process is performed by a conductive ink jetted from the plurality of nozzles, comprises: a recovery mechanism comprising at least a recovery unit for performing a recovery process for recovering from the clogging or contamination of the ink in the nozzle array and a power control unit for controlling a supply of power to the nozzle array drive unit, wherein the power control unit shuts off the power supply to the nozzle array drive unit when an abnormality occurs in the supporting and conveying of the recording medium that is performed by the conveyance mechanism in the recording process or when the recovery unit makes contact with the nozzle array for the recovery of the nozzle array in the recovery process.

Further, according to one of the other aspects of the present invention, a power shutoff process method for shutting off a power supply to a nozzle array drive unit of an image recording apparatus comprising at least one recording unit that includes a nozzle array constituted by a plurality of nozzles and the aforementioned nozzle array drive unit for driving the aforementioned nozzle array, and comprising a conveyance mechanism for supporting and conveying a recording medium that is conveyed from the upstream area of a conveyance path and on which a recording process is performed by a conductive ink jetted from the plurality of nozzles, comprises: judging whether or not an abnormality has occurred in the supporting and conveying of the recording medium that is performed by the conveyance mechanism in the recording process and whether or not a recovery process for recovering from an ink clogging in the nozzle array or contamination thereon has been performed; shutting off a power supply to the nozzle array drive unit if, according to the judgment, an abnormality has occurred in the supporting and conveying of the recording medium that is performed by the conveying mechanism; and judging whether or not the recovery unit is to make contact with the nozzle array during recovery of the nozzle array in the recovery process if the judgment is that the recovery process is started in the judgment, and shutting off a power supply to the nozzle array drive unit if the judgment is that the recovery unit is to make contact with the nozzle array in the judgment.

BRIEF DESCRIPTION OF THE DRAWINGS

The present invention will be more apparent from the following detailed description when the accompanying drawings are referenced.

DESCRIPTION OF THE PREFERRED EMBODIMENTS

The following is a detailed description of the preferred embodiment of the present invention, referring to the accompanying drawings.

Note that the following description is provided by defining the conveyance direction (i.e. the feed direction) of a recording medium as the Y direction, a direction orthogonal to the conveyance direction of the recording medium as the X direction or the width direction of the recording medium, and a direction orthogonal to the XY plane as the Z direction.

Figure 1:
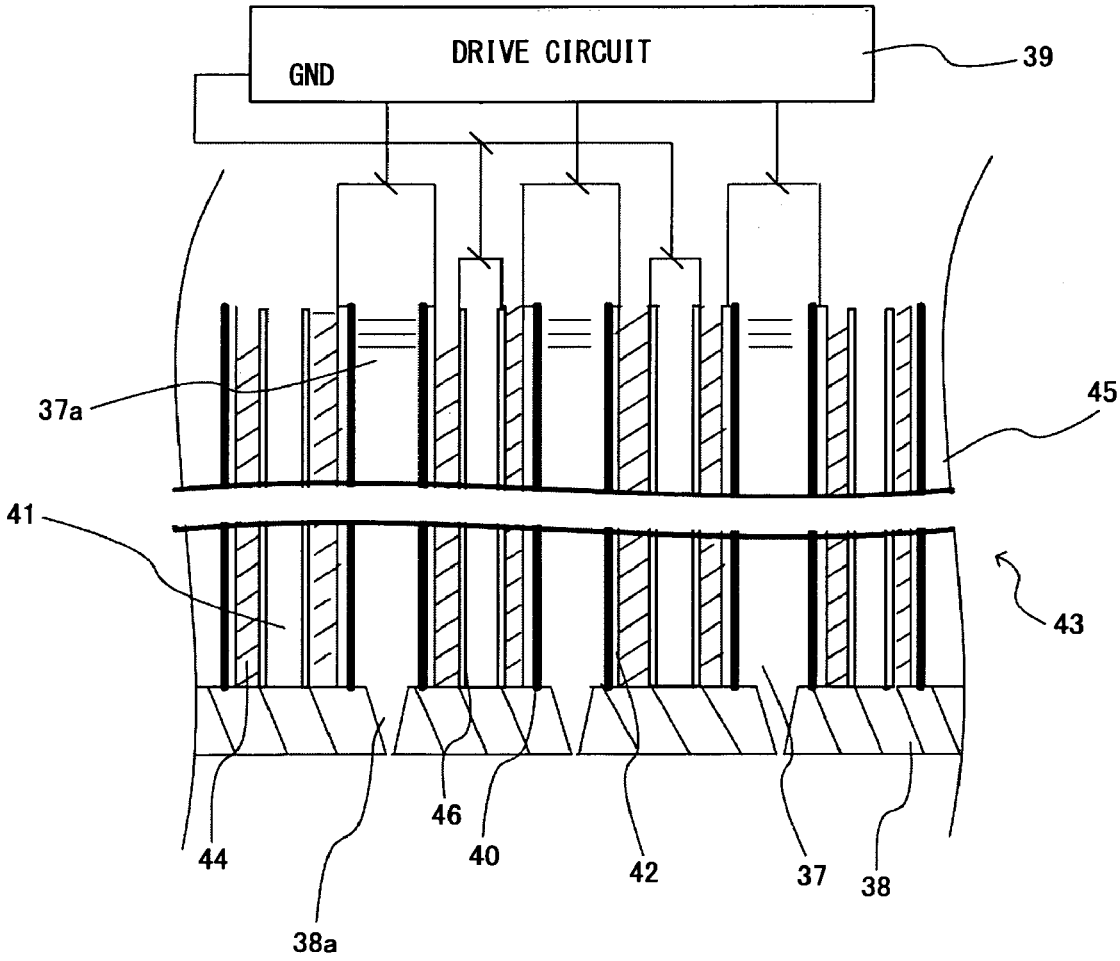
FIG. 1 PRIOR ART
FIG. 1 is a diagram illustrating the cross-section of a conventional recording head premising the use of a conductive ink.
Figure 2:
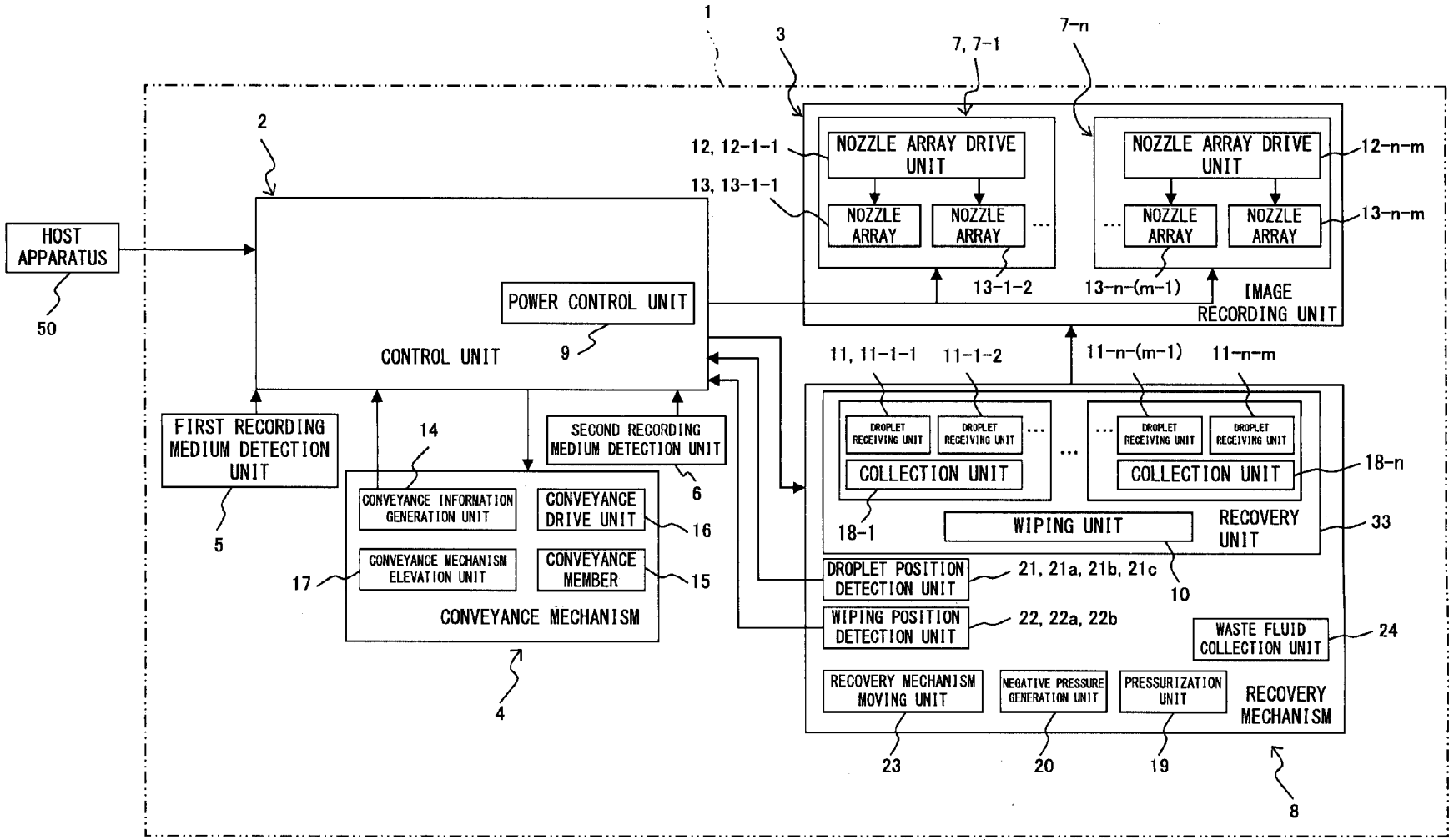
FIG. 2 is a diagram showing the conceptual configuration example of an image recording apparatus according to the present embodiment.

FIG. 2 is a diagram showing the conceptual configuration example of an image recording apparatus according to the present embodiment.

Figure 3:
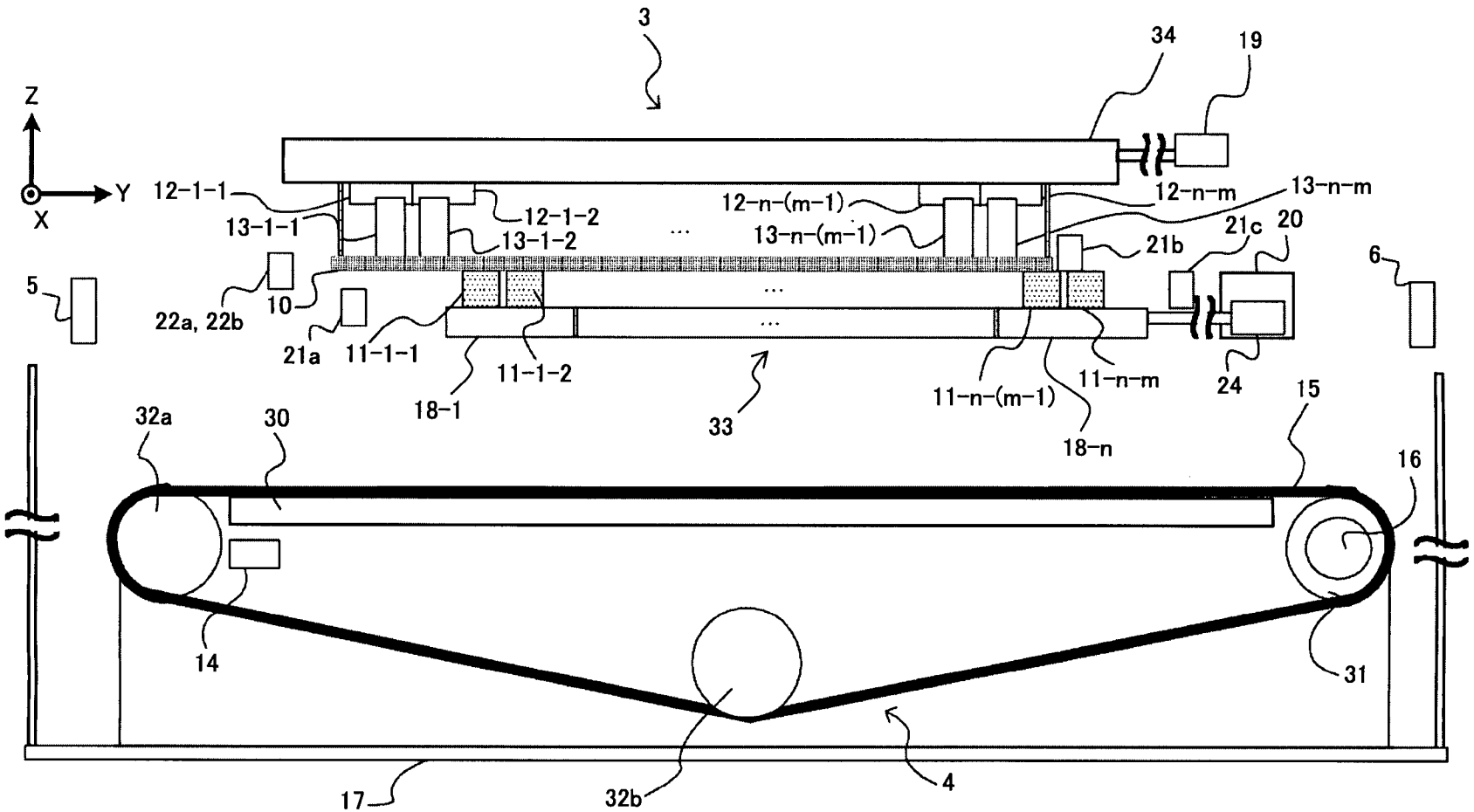
FIG. 3 is a side view diagram illustrating a layout example of an image recording apparatus according to the present embodiment.

Further, FIG. 3 is a side view diagram illustrating a layout example of an image recording apparatus according to the present embodiment.

Figure 4:
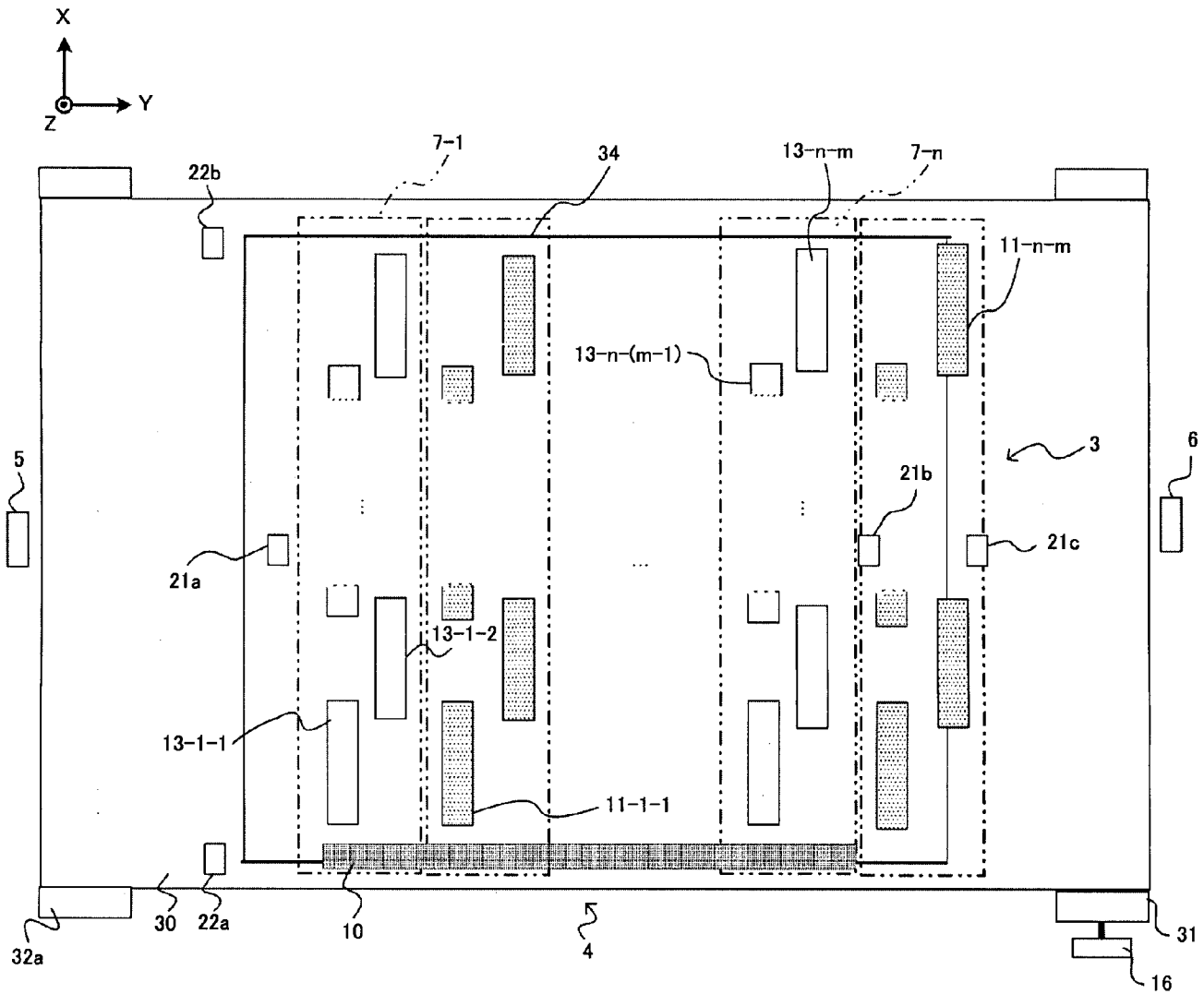
FIG. 4 is a top view diagram illustrating a layout example of an image recording apparatus according to the present embodiment.

Further, FIG. 4 is a top view diagram illustrating a layout example of an image recording apparatus according to the present embodiment.

The image recording apparatus 1 comprises a control unit 2, an image recording unit 3, a conveyance mechanism 4, a first recording medium detection unit 5, a second recording medium detection unit 6, and a recovery mechanism 8, as shown in FIG. 2.

Here, the control unit 2 controls the entirety of the image recording apparatus 1. The image recording unit 3 performs a recording process on a recording medium. The conveyance mechanism 4 conveys the recording medium downstream to the image recording unit 3. The first recording medium detection unit 5 detects an edge of the conveyed recording medium and reports the detected information to the control unit 2. The second recording medium detection unit 6 reports detected information to the control unit 2 when detecting the leading edge of a recording medium during a recording process (i.e., an image recording) performed by the image recording unit 3 or at the end of a recording process performed thereby. The recovery mechanism 8 recovers a nozzle array from an instance of ink clogging or contamination.

Incidentally, the image recording apparatus 1 comprises a feeding unit for supplying the conveyance mechanism 4 with a recording medium, and provides other constituent components in addition to the above noted components; they are, however, not depicted in the drawings herein.

The description continues further for the individual constituent components of the above described image recording apparatus 1 in detail.

The control unit 2 comprises a process circuit constituted by a microprocessor unit (MPU) possessing, for example, a control function and an arithmetic logical operation function, read only memory (ROM) for storing a control program and such, and nonvolatile memory storing the setup values and the like related to the control of the image recording apparatus 1. The control unit 2 controls the respective constituent components of the image recording apparatus 1.

The control unit 2 comprises a power control unit 9 that supplies or stops the power to the nozzle array drive units 12-1-1 through **12-*n*-*m* of the recording units 7-1 through 7-*n* on the basis of the later described state of the image recording apparatus 1. Note that the present embodiment is configured to store, in the ROM, the power control unit 9 as a control program to be read by, for example, the MPU comprised by the control unit 2. Then, the control unit 2 functions as the power control unit 9** by the MPU reading and executing the control program.

Note that the present embodiment may alternatively be configured such that the power control unit 9 is configured as a signal processing circuit including, for example, the control program, and such that the control program of the signal processing circuit is executed by the MPU and thereby the signal processing circuit functions as the power control unit 9.

The image recording unit 3 comprises the recording units 7-1 through **7-*n***.

The recording units 7-1 through **7-*n* include the nozzle array drive units 12-1-1 through 12-*n*-*m* and nozzle arrays 13-1-1 through 13-*n*-*m*, and the nozzle array drive units 12-1-1 through 12-*n*-*m* and nozzle arrays 13-1-1 through 13-*n*-*m* are placed in such a manner as to be attached to the bottom of a support member 34 as shown in FIGS. 3 and 4. When receiving respective instructions from the control unit 2, the nozzle array drive units 12-1-1 through 12-*n*-*m* cause the ink to be jetted by driving the nozzle arrays 13-1-1 through 13-*n*-*m*. The recording units 7-1 through 7-*n* cause the ink to be jetted as described above, thereby performing a recording process (i.e., an image recording) by using image data and the positional information of the recording medium, which are both received from the control unit 2**.

The recovery mechanism 8 comprises a recovery unit 33, at least one or more droplet position detection units 21, at least one or more wiping position detection units 22, a pressurization unit 19, a negative pressure generation unit 20, a recovery mechanism moving unit 23, and a waste fluid collection unit 24. Here, the recovery unit 33 includes droplet receiving units 11-1-1 through **11-*n*-*m*, wiping unit 10 and collection units 18-1 through 18-*n***.

Incidentally, the recovery mechanism 8 is grounded to the frame of the image recording apparatus 1 as a countermeasure against static electricity and such.

The droplet receiving units 11-1-1 through **11-*n*-*m* are placed to be opposite to the respective recording units 7-1 through 7-*n* when a recovery process is carried out in the image recording apparatus 1 for recovering the nozzle arrays 13-1-1 through 13-*n*-*m* from clogging or contamination with ink. In this case, the droplet receiving units 11-1-1 through 11-*n*-*m* receive the ink jetted from the nozzle arrays 13-1-1 through 13-*n*-*m*. Note that the droplet receiving units 11-1-1 through 11-*n*-*m* are supported by the collection units 18-1 through 18-*n***, respectively.

The wiping unit 10 wipes the ink jetted from the nozzle arrays 13-1-1 through **13-*n*-*m* and is supported by the support member 34 movably in the X direction, as shown in FIG. 3**.

The collection units 18-1 through **18-*n* and wiping unit 10 retract to respective positions so as to not obstruct the operation of a recording process when the image recording apparatus 1** performs a recording process.

In contrast, when the image recording apparatus 1 starts a recovery process, the recovery mechanism moving unit 23, upon receiving an instruction from the control unit 2, moves the droplet receiving units 11-1-1 through **11-*n*-*m* and wiping unit 10 to appropriate respective positions in accordance with the recovery process category (i.e., recovery mode) described later. Note that the moving operation performed by the recovery mechanism moving unit 23 is carried out on the basis of the positional detection information of the droplet receiving units 11-1-1 through 11-*n*-*m* and the positional detection information of the wiping unit 10. Here, pieces of the positional detection information of the droplet receiving units 11-1-1 through 11-*n*-*m* are obtained by the droplet position detection unit 21 (i.e., the droplet position detection units 21*a*, 21*b* and 21*c* in the configuration shown in FIGS. 3 and 4). Further, pieces of the positional detection information of the wiping unit 10 are obtained by the wiping position detection unit 22 (i.e., the wiping position detection units 22*a* and 22*b* in the configuration shown in FIGS. 3 and 4). After completing the movement, the control unit 2 controls the pressurization unit 19 and negative pressure generation unit 20 in accordance with a later described recovery mode so as to cause the nozzle arrays 13-1-1 through 13-*n*-*m* to jet the ink. The ink jetted in this event is collected by the collection units 18-1 through 18-*n* and is sent to the waste fluid collection unit 24**.

The conveyance mechanism 4 comprises a conveyance information generation unit 14, a conveyance member 15, a conveyance drive unit 16 and a conveyance mechanism elevation unit 17.

Incidentally, it is assumed that the conveyance mechanism 4 is grounded to the frame of the image recording, apparatus 1 as a countermeasure to static electricity and such.

The conveyance member 15 includes an endless belt for supporting and conveying a recording medium fed out of a feeding unit (not shown in a drawing herein) and handed over as shown in FIG. 3. The conveyance member 15 is mounted around a drive roller 31 and driven rollers **32*a* and 32*b*, and is equipped so as to move rotationally when making contact with and sliding across the upper surface of a platen 30**.

The conveyance drive unit 16 is connected to the drive roller 31, which is driven when the conveyance drive unit 16 receives an instruction from the control unit 2.

The driven roller **32*a* is equipped with, for example, a rotary encoder comprised by the conveyance information generation unit 14. The conveyance information generation unit 14 generates a pulse signal corresponding to the movement amount of the conveyance member 15 and sends the signal to the control unit 2**.

Note that the conveyance mechanism 4 is supported by the conveyance mechanism elevation unit 17 and is configured to be slidable in the up/down direction (i.e., the Z direction) within the image recording apparatus 1. When receiving an instruction from the control unit 2, the conveyance mechanism elevation unit 17 lifts or lowers the conveyance mechanism 4 to the position on the right side to start a recording process. The recording units 7-1 through **7-*n* are equipped in a position opposite to and above the conveyance mechanism 4. The recording units 7-1 through 7-*n* are equipped so that the respective nozzles of the nozzle arrays 13-1-1 through 13-*n*-*m* are placed across the width direction (i.e., the X direction) of the recording medium, the direction orthogonal to the conveyance direction (i.e., the Y direction) of the recording medium. Such placements of the nozzle arrays 13-1-1** through 13-*n*-*m* pseudo-configures a wide line-head corresponding to a single colored ink.

The first recording medium detection unit 5 detects a recording medium supportively placed on the conveyance mechanism 4. The first recording medium detection unit 5 is equipped at a predetermined spot in the area upstream from the recording units 7-1 through 7-*n* on the conveyance path of the recording medium. Further, specifically, the first recording medium detection unit 5 detects at least two pieces of information, i.e., the information detected at the time the leading edge of the recording medium in the conveyance direction reaches the aforementioned predetermined spot and the information detected at the time the trail edge of the recording medium in the conveyance direction reaches the aforementioned predetermined spot, and reports them to the control unit 2.

The second recording medium detection unit 6 also detects a recording medium supportively placed on the conveyance mechanism 4. The second recording medium detection unit 6 is equipped at a predetermined spot in the area downstream from the recording units 7-1 through 7-*n* on the conveyance path of the recording medium. Further, specifically, the second recording medium detection unit 6 detects at least two pieces of information, i.e., the information detected at the time the leading edge of the recording medium in the conveyance direction reaches the aforementioned predetermined spot after completing the recording process and the information detected at the time the trailing edge of the recording medium in the conveyance direction reaches the aforementioned predetermined spot after completing the recording process, and reports them to the control unit 2.

Regarding the "n" and "m" affixed to the signs of the individual constituent components noted above, where n and m are respective integers no smaller than "2", n corresponds to the number of recording units 7 while m corresponds to the respective numbers of droplet receiving units 11, nozzle array drive units 12, and nozzle arrays 13.

Here, specific examples of the signs n and m are described.

The description here is provided by exemplifying a configuration in which the image recording unit 3 of the image recording apparatus 1 comprises the recording units 7 corresponding to, for example, four colored inks, with these recording units 7 comprising six nozzle arrays 13, respectively.

The image recording unit 3 accordingly comprises the recording units 7-1 through 7-4.

Further, the recording units 7-1 through 7-4 consist of the nozzle arrays 13-1-1 through 13-4-24.

Next is a description of the major operation of the image recording apparatus 1.

When receiving job information required for an image recording from, for example, a host apparatus 50 that is a host computer, the control unit 2 starts to supply the recording units 7-1 through 7-*n* with power. In addition, the control unit 2 instructs a feeding unit (not shown in a drawing herein) to feed a recording medium to the conveyance mechanism 4. The feeding unit (not shown in a drawing herein) feeds the recording medium one-by-one so as to hand it to the conveyance mechanism 4.

The control unit 2 judges whether or not the recording medium has reached a position opposite to the recording units 7-1 through 7-*n* on the basis of the detection information detected by the first recording medium detection unit 5 and the information of the conveyance information generation unit 14. Here, the control unit 2 instructs the nozzle array drive units 12-1-1 through 12-*n*-*m* of the recording units 7-1 through 7-*n* to drive the nozzle arrays 13-1-1 through 13-*n*-*m* if the recording medium is judged to have reached this position. This prompts the nozzle arrays 13-1-1 through 13-*n*-*m* to perform a recording process to the recording medium reaching this position. Having completed the recording process by passing through the opposite position, the recording medium is output to an output unit (not shown in a drawing herein) from the conveyance mechanism 4 on the basis of the detection information detected by the second recording medium detection unit 6.

Note that the control unit 2 judges whether or not the recording medium has been output from the conveyance mechanism 4 on the basis of the pieces of information respectively obtained from the conveyance information generation unit 14, first recording medium detection unit 5, and second recording medium detection unit 6. Here, if the recording medium is judged to have not been normally output, the control unit 2 stops the recording process and reports to the user, by way of a reporting unit (not shown in a drawing herein), that a conveyance failure has occurred. In this case, the user removes the recording medium left in the conveyance mechanism 4 due to the conveyance failure, then instructs the image recording apparatus 1 to restart the recording process.

Also, the control unit 2 judges whether or not there is a need to start a recovery process for the nozzle arrays 13 on the basis of various conditions such as receiving an instruction from the user, the elapsing of a predetermined length of time, the completion of the recording process for a preset number of prints, etc. Here, if the control unit 2 judges that a recovery process needs to be started, it moves the wiping unit 10 and droplet receiving units 11-1-1 through 11-*n*-*m*, which have been retracted, to the appropriate positions on the basis of the pieces of information respectively detected by the droplet position detection units 21*a* and 21*b* and wiping position detection unit 22*b*. Then, after they are moved, the control unit 2 starts a recovery process for the respective nozzle arrays 13-1-1 through 13-*n*-*m*. When completing the recovery process, the control unit 2 retracts the wiping unit 10 and droplet receiving units 11-1-1 through 11-*n*-*m* on the basis of the detected information of the droplet position detection unit 21*c* and wiping position detection unit 22*a*, thereby standing by to restart the next recording process.

Note that the reporting unit (not shown in a drawing herein) may be equipped in the display unit of a user operation panel (which is not shown in a drawing of the configuration example according to the present embodiment) comprised by the image recording apparatus 1, or may be equipped in a structure separate from the display unit.

Next is a description of the method for shutting off the power that is carried out when a recording medium conveyance failure occurs, as one method of a power shutoff action performed in the image recording apparatus 1.

Figure 5:
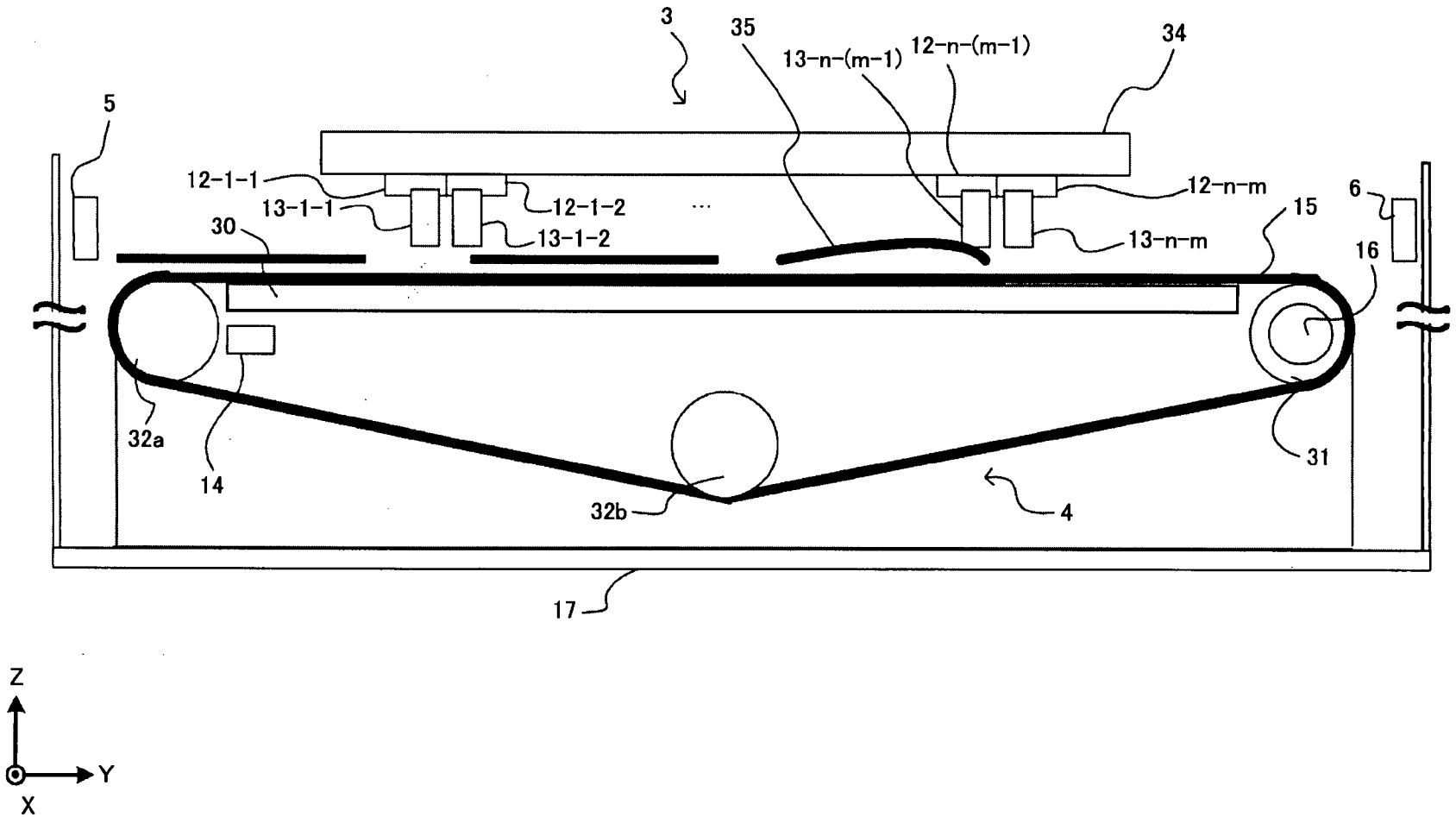
FIG. 5 is a diagram illustrating the occurrence of a conveyance failure of a recording medium in the image recording apparatus shown in FIG. 2.

FIG. 5 illustrates the occurrence of a conveyance failure of a recording medium in the image recording apparatus 1.

Having received the information required for a recording process from a host apparatus 50, the control unit 2 elevates or lowers the conveyance mechanism 4 in compliance with the instruction from the conveyance mechanism elevation unit 17, moves the conveyance mechanism 4 to an appropriate position for a recording process and remains ready therefor. Upon the completion of moving the conveyance mechanism 4, the control unit 2 feeds a recording medium from the feeding unit (not shown in a drawing herein) sheet by sheet to the conveyance mechanism 4 and conveys the recording medium thereto. Then the control unit 2 judges whether or not the recording medium has reached a position opposite to the recording units 7-1 through 7-*n* on the basis of the detection information obtained by the first recording medium detection unit 5 and the information obtained by the conveyance information generation unit 14. If the recording medium is judged to have reached this position, the control unit 2 instructs the nozzle array drive units 12-1-1 through **12-*n-m* of the respective recording units 7-1 through 7-*n* to drive the nozzle arrays 13-1-1 through 13-*n-m*, respectively. This prompts the nozzle arrays 13-1-1 through 13-*n-m*** to perform a recording process on the recording medium that has reached the position mentioned above.

The recording medium 35, however, sometimes comes into contact with a nozzle array 13 due to the occurrence of warping caused by moisture, and the recording medium may lift off the conveyance member 15 during conveyance in a recording process, as exemplified in FIG. 5. If it comes into contact with the nozzle array 13, the recording medium 35 sometimes may not be ejected to the output unit (not shown in a drawing herein). The control unit 2 comprised in the image recording apparatus 1 according to the present embodiment is configured to judge whether or not the recording medium 35 has been output from the conveyance mechanism 4 on the basis of the respective pieces of information obtained from the first recording medium detection unit 5, second recording medium detection unit 6, and conveyance information generation unit 14. If the recording medium 35 is judged to not have been ejected, the control unit 2 causes the recording process to stop in the image recording apparatus 1. When this happens, the power control unit 9 shuts off the power to the nozzle array drive units 12-1-1 through **12-*n-m* and stops the supply of power thereafter until it receives a report that the recording medium 35 left in the conveyance mechanism 4** due to the conveyance failure has been removed.

Note that the control unit 2 comprised in the image recording apparatus 1 according to the present embodiment is configured to judge whether or not the recording medium 35 has been ejected from the conveyance mechanism 4 to the output unit (not shown in a drawing herein) after, for example, the elapse of a predetermined length of time from the time the first recording medium detection unit 5 detects the leading edge of the recording medium in the conveyance direction. Also configured is the control unit 2 making the aforementioned judgment, by virtue of a time monitoring, as to whether or not the lead edge of the aforementioned recording medium 35 in the conveyance direction has been detected by the second recording medium detection unit 6 within a predetermined period of time.

The image recording apparatus 1 according to the present embodiment premises a case in which the recording medium coming into contact with, for example, the nozzle array 13 causes the conductive ink to flow along the recording medium, resulting in the aforementioned ink running down to a position in the conveyance mechanism 4 where ink is not usually present. The image recording apparatus 1 according to the present embodiment is configured to prevent the occurrence of a short circuiting of the power system of the present image recording apparatus 1 in the aforementioned case if, for example, an insulation failure has occurred in the insulation film of a discrete electrode in any of the above described ink chambers within a nozzle array 13.

The image recording apparatus 1 according to the present embodiment is configured to perform such a power shutoff action, thereby preventing further failures in the present image recording apparatus 1.

Next is a description of the method for shutting off the power that is carried out when executing a recovery process operation as another of the power shutoff actions performed in the image recording apparatus 1.

Figure 6A:
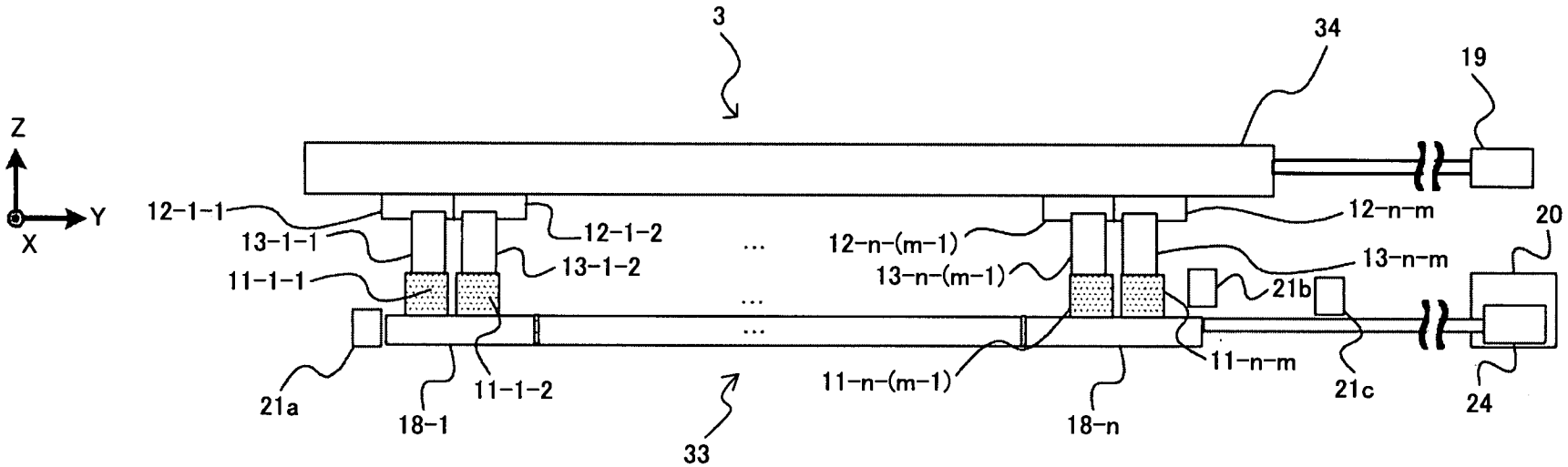
FIG. 6A is a diagram illustrating a first aspect of a recovery process operation in the image recording apparatus shown in FIG. 2.
Figure 6B:
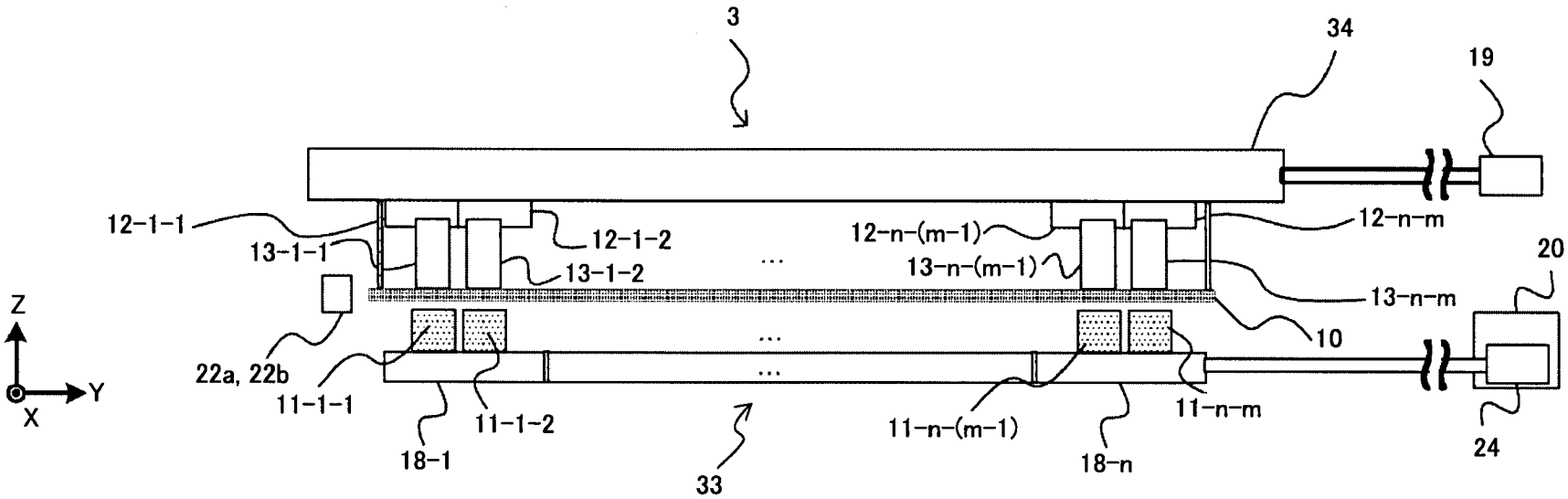
FIG. 6B is a diagram illustrating a second aspect of a recovery process operation in the image recording apparatus shown in FIG. 2.
Figure 6C:
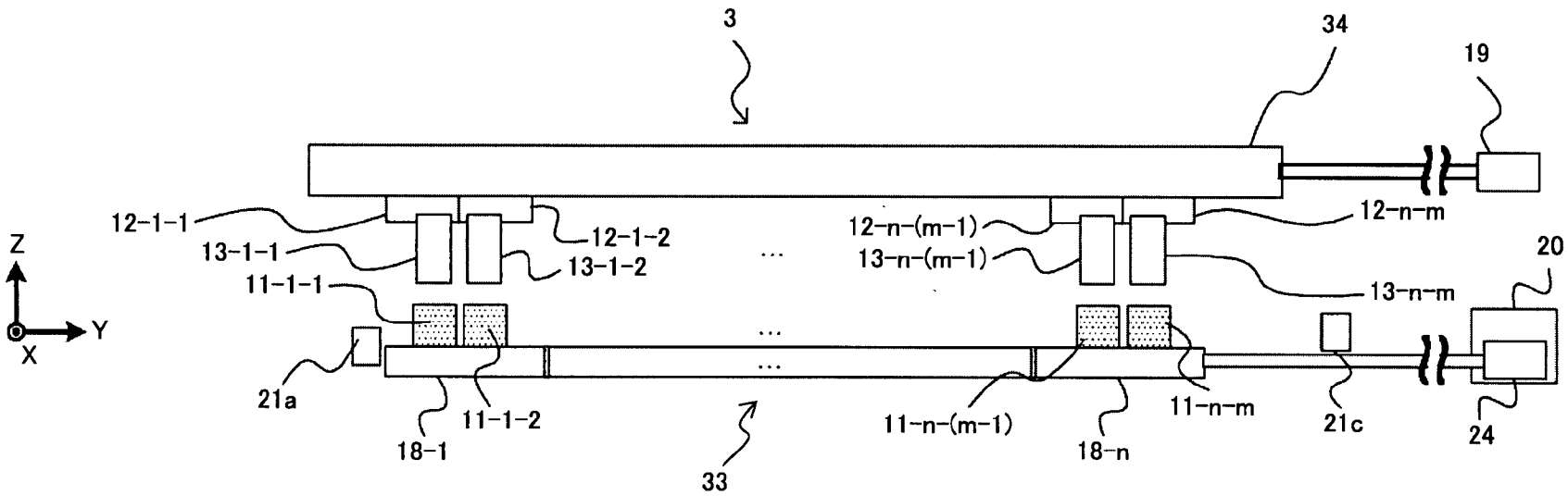
FIG. 6C is a diagram illustrating a third aspect of a recovery process operation in the image recording apparatus shown in FIG. 2.

FIGS. 6A, 6B and 6C respectively illustrate the individual aspect of a recovery process operation in the image recording apparatus 1. The nozzle arrays 13-1-1 through **13-*n-m* are connected to the nozzle array drive units 12-1-1 through 12-*n-m* for driving the present nozzle arrays 13-1-1 through 13-*n-m* to jet the ink. The nozzle arrays 13-1-1 through 13-*n-m* are connected to the pressurization unit 19. The droplet receiving units 11-1-1 through 11-*n-m* are connected to the negative pressure generation unit 20 and waste fluid collection unit 24**.

FIG. 6A shows the first aspect (i.e., mode A) of the recovery process operation. The recovery process operation in mode A recovers from an ink clogging in any of the nozzle arrays 13-1-1 through **13-*n-m* via the negative pressure generation unit 20 suctioning the ink from the nozzle arrays 13-1-1 through 13-*n-m* from the side of the droplet receiving units 11-1-1 through 11-*n-m***.

Having received an instruction from the control unit 2 for moving the recovery unit 33 for a recovery process operation in the mode A, the recovery mechanism moving unit 23 first moves the droplet receiving units 11-1-1 through **11-*n-m* from the retract position to a position opposite to the nozzle arrays 13-1-1 through 13-*n-m* on the basis of the detection information detected by the droplet position detection unit 21*a*. Then, the recovery mechanism moving unit 23 moves the droplet receiving units 11-1-1 through 11-*n-m* so that they touch the nozzle arrays 13-1-1 through 13-*n-m* on the basis of the detection information detected by the droplet position detection unit 21*b*. This is followed by the control unit 2 instructing the negative pressure generation unit 20 to begin suctioning the ink existing in the nozzle arrays 13-1-1 through 13-*n-m***.

In the mode A recovery process operation, the droplet receiving units 11-1-1 through **11-*n-m* make contact with the respective nozzle plates of the nozzle arrays 13-171 through 13-*n-m*. Accordingly, the power control unit 9 stops the supply of power to the nozzle array drive units 12-1-1 through 12-*n-m* until the completion of the recovery process, thereby preventing the further advance of the above described failure in the image recording apparatus 1**.

FIG. 6B shows the second aspect (i.e., mode B) of the recovery process operation. In a recovery process operation in mode B, the pressurization unit 19 pressurizes the inside of the ink chamber within the nozzle arrays 13-1-1 through **13-*n-m* so as to have the ink jetted therefrom. Then the wiping unit 10 wipes the contamination from the nozzle arrays 13-1-1 through 13-*n-m* caused by the jetted ink and thereby the nozzle arrays 13-1-1 through 13-*n-m*** recover.

Having received an instruction from the control unit 2 to move the recovery unit 33 in order to undergo a recovery process operation in mode B, the recovery mechanism moving unit 23 first moves the droplet receiving units 11-1-1 through **11-*n-m* from the retracted position to a position opposite to the nozzle arrays 13-1-1 through 13-*n-m* on the basis of the detection information detected by the droplet position detection unit 21*a*. Then the recovery mechanism moving unit 23 causes the wiping unit 10 to slide across the nozzle arrays 13-1-1 through 13-*n-m* and move in the width direction of the recording medium. The respective nozzle plates of the nozzle arrays 13-1-1 through 13-*n-m*** are wiped by the moving action.

In the mode B recovery process operation, the wiping unit 10 is touched to the nozzle arrays 13-1-1 through **13-*n-m*. For this operation, the power control unit 9 first shuts off the power to the nozzle array drive units 12-1-1 through 12-*n-m*. Then the control unit 2 instructs the pressurization unit 19 to pressurize the nozzle arrays 13-1-1 through 13-*n-m* and also instructs the recovery mechanism moving unit 23 to have the wiping unit 10 carry out a wiping action. The power control unit 9 continues preventing power from being supplied to the nozzle array drive units 12-1-1 through 12-*n-m* until the completion of the recovery process, thereby preventing the further advance of the above described failure in the image recording apparatus 1**.

FIG. 6C shows the third aspect (i.e., mode C) of the recovery process operation. In the mode C recovery process operation, the operations are carried out intermittently at a predetermined interval in which the nozzle array drive units 12-1-1 through **12-*n-m* drive the nozzle arrays 13-1-1 through 13-*n-m* to jet the ink. By so doing, the nozzle arrays 13-1-1 through 13-*n-m* are caused to recover from ink clogging without using the pressurization unit 19, negative pressure generation unit 20, or wiping unit 10**.

Having received an instruction from the control unit 2 to move the recovery unit 33 in order to perform a mode C recovery process operation, the recovery mechanism moving unit 23 first moves the droplet receiving units 11-1-1 through **11-*n-m* from the retract position to a position opposite to the nozzle arrays 13-1-1 through 13-*n-m* on the basis of the detection information detected by the droplet position detection unit 21*a*. In the mode C recovery process operation, however, neither droplet receiving units 11-1-1 through 11-*n-m* nor wiping unit 10 is touched to the nozzle arrays 13-1-1 through 13-*n-m*. Therefore, the above described failure does not occur any further in the image recording apparatus 1 even if the power control unit 9 does not stop supplying power to the nozzle array drive units 12-1-1 through 12-*n-m*. Then, the control unit 2 controls the nozzle array drive units 12-1-1 through 12-*n-m* so as to have them start the operation of jetting ink from the nozzle arrays 13-1-1 through 13-*n-m* and thereby making them start a recovery operation therefor. Note that the configuration is also such that the distance between the nozzle arrays 13-1-1 through 13-*n-m* and droplet receiving units 11-1-1 through 11-*n-m* in this case is retained so as to prevent current leakage to the recovery mechanism 8 from occurring when the conductive ink is jetted from the nozzle arrays 13-1-1 through 13-*n-m***.

The individual mode of the recovery process operations described above is selected by the user by way of, for example, the above described user operation-use panel when carrying out, for example, the recovery process operation.

Figure 7:
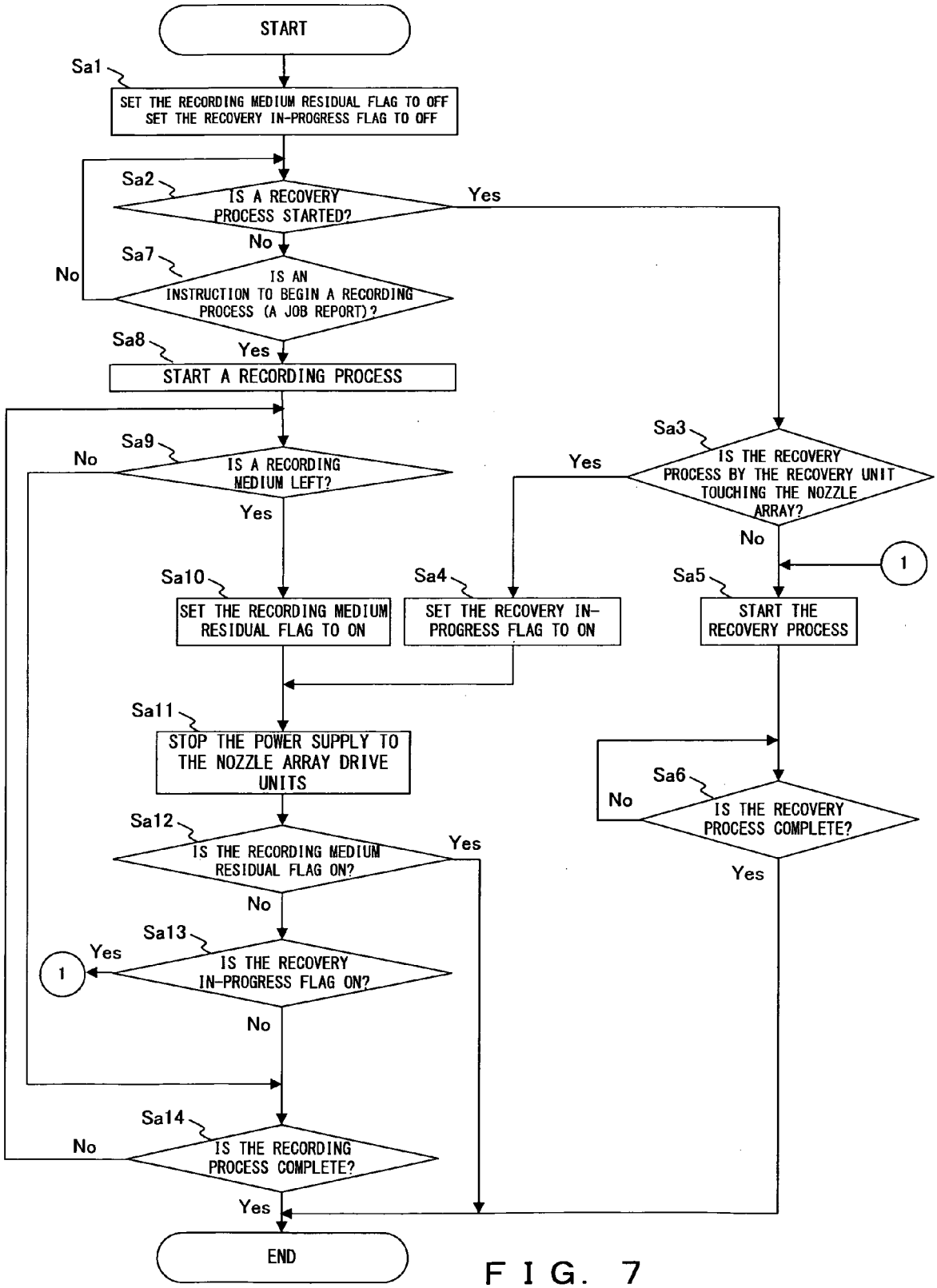
FIG. 7 is a diagram showing the process content of a power shutoff control process in a flow chart.

Next is a description of a power shutoff control process performed by the power control unit 9 comprised by the image recording apparatus 1 for implementing the above described operation of shutting off the power supply to the nozzle arrays 13-1-1 through **13-*n-m*. FIG. 7** shows the process content of a power shutoff control process in a flow chart.

The power shutoff control process shown in FIG. 7 is attained by the MPU comprised by the control unit 2 functioning as the power control unit 9 as a result of reading a control program pre-stored in the ROM and executing the control program.

As the power shutoff control process shown in FIG. 2 is started, the control unit 2 first performs the process for setting both of two predefined flags, i.e., a recording medium residual flag and a recovery in-progress flag, to "Off" in step Sa1 (sometimes simply noted as "Sa1" hereinafter). Here, the recording medium residual flag is for indicating the occurrence of a recording medium conveyance failure. The recording medium residual flag is set to "On" by a process described above when the occurrence of a recording medium conveyance failure is detected and until the reception of a report that the recording medium has been removed. Meanwhile, the recovery in-progress flag is for indicating the carrying out of a recovery process operation. The recovery in-progress flag is set to "On", by a process described later, during the time period of performing a recovery process operation.

Next, the control unit 2 judges whether or not a recovery process is about to be started by the recovery unit 33 in Sa2. If the judgment is that the recovery process is about to be started (i.e., if the judgment result is "yes"), the control unit 2 shifts the process to Sa3. In contrast, if the judgment is that a recovery process is not about to be started (i.e., if the judgment result is "no"), it shifts the process to Sa7.

Next, in Sa3, the control unit 2 judges whether or not the recovery process carried out by the recovery unit 33 is the process performed by causing the droplet receiving units 11-1-1 through **11-*n-m* or wiping unit to touch the nozzle arrays 13-1-1 through 13-*n-m*. That is, the control unit 2 judges whether the recovery process operation is in the above described mode A or mode B. If the recovery process about to start is judged to be the process of the nozzle arrays 13-1-1 through 13-*n-m* being touched (i.e., if the judgment result is "yes"), the control unit 2 shifts the process to Sa4 and sets the recovery in-progress flag to "On", followed by shifting the process to Sa11. In contrast, if the recovery process about to start is judged to be the process of the nozzle arrays 13-1-1 through 13-*n-m* not being touched (i.e., if the judgment result is "no"), that is, a recovery process operation in the above described mode C is about to start, the control unit 2 shifts the process to Sa5 and performs the process for starting the recovery process, followed by shifting the process to Sa6**.

Then, the control unit 2 judges whether or not the recovery process started in the process of Sa5 is complete in Sa6. If the recovery process is judged to be complete (i.e., if the judgment result is "yes"), the control unit 2 ends the present power shutoff control process. In contrast, if the recovery process is judged to be not complete (i.e., if the judgment result is "no"), the control unit 2 repeats the judgment process of Sa6 until the recovery process is complete.

Then, the control unit 2 judges whether or not job information necessary for a recording process (i.e., an image recording) is received by the present control unit 2 from a host apparatus 50 in Sa7. If the job information is judged to have been received (i.e., if the judgment result is "yes"), the control unit 2 shifts the process to Sa8 and performs the process for starting a recording process, followed by shifting the process to Sa9. In contrast, if such job information is judged to be not received (i.e., if the judgment result is "no"), the control unit 2 shifts the process to Sa2 for repeating the above described processes.

Then, the control unit 2 judges whether or not a recording medium 35 is left in the conveyance mechanism 4 in Sa9. If the recording medium 35 is judged to have been left (i.e., if the judgment result is "yes"), the control unit 2 shifts the process to Sa10 and sets the recording medium residual flag to "On", followed by shifting the process to Sa11. In contrast, if a recording medium 35 is judged to not have been left (i.e., if the judgment result is "no"), the control unit 2 shifts the process to Sa14.

Then, the control unit 2 stops the power supply to the nozzle array drive units 12-1-1 through **12-*n-m* in Sa11**.

Then the control unit 2 judges whether or not the recording medium residual flag is set to "On" in Sa12. If the recording medium residual flag is judged to be set to "On" (i.e., if the judgment result is "yes"), the control unit 2 ends the present power shutoff control process. In contrast, if the recording medium residual flag is judged to be set to "Off" (i.e., if the judgment result is "no"), the control unit 2 shifts the process to Sa13.

Then, the control unit 2 judges whether or not the recovery in-progress flag is set to "On" in Sa13. If the recovery in-progress flag is judged to be set to "On" (i.e., the judgment result is "yes"), the control unit 2 shifts the process to Sa5 and performs the process for starting the recovery process as described above, followed by shifting the process to Sa6. In contrast, if the recovery in-progress flag is judged to be set to "Off" (i.e., the judgment result is "no"), the control unit 2 shifts the process to Sa14.

Then, the control unit 2 judges whether or not the recording process started in Sa8 is complete in Sa14. If the aforementioned recording process is judged to be complete (i.e., if the judgment result is "yes"), the control unit 2 ends the present power shutoff control process. In contrast, if the recording process is judged to be in progress (i.e., if the judgment result is "no"), the control unit 2 shifts the process to Sa9 and repeats the above described processes.

The process described above is the power shutoff control process. The control unit 2 carrying out the aforementioned process shuts off the power to the nozzle array drive units 12-1-1 through **12-*n*-*m* so as to prevent further failures from occurring in the image recording apparatus 1 when a conveyance failure of the recording medium 35 occurs in the image recording apparatus 1** or when a recovery process is carried out therein.

As described above, the image recording apparatus 1 according to the present embodiment is configured to shut off the power to the nozzle array drive units 12-1-1 through **12-*n*-*m* as appropriate when a conveyance failure of a recording medium 35 occurs or when a recovery process is carried out in the present image recording apparatus 1. With this configuration, the image recording apparatus 1 according to the present embodiment is enabled to prevent further failures from occurring, in a recording process using a conductive ink, in the image recording apparatus 1 caused by an insulation defect and the conductive ink even if an insulation defect has occurred within the nozzle of a nozzle array 13**.

Although the preferred embodiments of the present invention have been respectively described, the present invention can be changed or modified in various possible ways within the scope of the present invention, in lieu of being limited by the embodiments described above.

The image recording apparatus 1 according to the present embodiment may allow the elimination of some constituent components from the overall comprisal shown in the method for shutting off the power when, for example, a recording medium conveyance failure occurs, or when, for example, a recovery process is carried out, or the constituent components used across different embodiments may be appropriately combined. The control unit 2 may be configured to change, by way of modifying the control content of, for example, the power control unit 9, the timing for stopping power from being supplied to the nozzle array drive units 12-1-1 through **12-*n*-*m* to the point in time when the movement of the recovery unit 33** is started, in accordance with the category of the operation mode of a recovery process operation.

What is claimed is:

1. An image recording apparatus comprising:

at least one recording unit that includes a nozzle array constituted by a plurality of nozzles and a nozzle array drive unit for driving the nozzle array;

a conveyance mechanism for supporting and conveying a recording medium, which is conveyed from an upstream area of a conveyance path and on which a recording process is performed by jetting ink from the plurality of nozzles;

a recovery mechanism comprising a recovery unit for performing a recovery process for recovering from clogging or contamination of the ink in the nozzle array;

a conveyance abnormality detection unit for detecting an abnormality in the supporting and conveying of the recording medium performed by the conveyance mechanism; and a power control unit for controlling a supply of power to the nozzle array drive unit, wherein the ink has conductivity, and wherein when the conveyance abnormality detection unit detects an occurrence of an abnormality in the supporting and conveying of the recording medium that is performed by the conveyance mechanism in the recording process or when the recovery unit makes contact with the nozzle array for the recovery of the nozzle array in the recovery process, the power control unit performs control so as to shut off power supply to the nozzle array drive unit only.

2. The image recording apparatus according to claim 1, further comprising:

a control unit comprising the power control unit, wherein the control unit comprises a microprocessor unit and a storage unit storing a control program for making the microprocessor unit function as the power control unit by executing the control program.

3. The image recording apparatus according to claim 1, further comprising:

a first recording medium detection unit, provided in an upstream area of the conveyance mechanism in the conveyance path, for detecting an edge of the recording medium, and a second recording medium detection unit, provided in a downstream area of the conveyance mechanism in the conveyance path, for detecting an edge of the recording medium, wherein the conveyance abnormality detection unit detects an occurrence of an abnormality in the supporting and conveying of the recording medium performed by the conveyance mechanism, based on a detection result obtained by the first recording medium detection unit and a detection result obtained by the second recording medium detection unit.

4. The image recording apparatus according to claim 1, wherein the recovery unit comprises:

a wiping unit for wiping the nozzle array by sliding the wiping unit on the nozzle array, a receiving unit for at least receiving the ink jetted from the nozzle array, and a collection unit for collecting the ink wiped by the wiping unit or received by the receiving unit, and wherein the recovery mechanism moves the recovery unit to any of the following positions: a retracting position for letting the ink jetted from the nozzles reach the recording medium in the recording process, a position to make the receiving unit come into contact with the nozzle array, and a position to make the wiping unit slide across the nozzle array.

5. The image recording apparatus according to claim 4, wherein the recovery mechanism further comprises a recovery mechanism moving unit for moving the recovery unit.

6. The image recording apparatus according to claim 4, wherein the recovery mechanism further comprises a negative pressure generation unit for sucking up ink clogging the nozzle array from the side of the receiving unit.

7. The image recording apparatus according to claim 6, wherein the recovery mechanism further comprises a waste collection unit to collect the ink sucked up by the negative pressure generation unit.

8. The image recording apparatus according to claim 4, wherein the recovery mechanism further comprises a pressure unit for ejecting clogging ink from the nozzle array by pressurizing an ink chamber within the nozzle array.

9. A power shutoff method for shutting off power supply to a nozzle array drive unit of an image recording apparatus, wherein the image recording apparatus comprises (i) at least one recording unit that includes a nozzle array constituted by a plurality of nozzles and the nozzle array drive unit for driving the nozzle array, (ii) a conveyance mechanism for supporting and conveying a recording medium, which is conveyed from an upstream area of a conveyance path and on which a recording process is performed by jetting ink from the plurality of nozzles, and (iii) a recovery mechanism comprising a recovery unit for performing a recovery process for recovering from clogging or contamination of the ink in the nozzle array, the method comprising:

detecting an abnormality in the supporting and conveying of the recording medium performed by the conveyance mechanism;

judging whether or not an abnormality in the supporting and conveying of the recording medium that is performed by the conveyance mechanism has been detected in the recording process and whether or not the recovery process is being performed;

shutting off the power supply to only the nozzle array drive unit if it is judged that an abnormality in the supporting and conveying of the recording medium that is performed by the conveying mechanism has been detected; and judging whether or not the recovery unit is to make contact with the nozzle array during recovery of the nozzle array in the recovery process if it is judged that the recovery process has started, and shutting off the power supply to only the nozzle array drive unit if it is judged that the recovery unit is to make contact with the nozzle array, wherein the ink has conductivity.

* * * * *